US009537240B2

(12) United States Patent
Kato et al.

(10) Patent No.: US 9,537,240 B2
(45) Date of Patent: Jan. 3, 2017

(54) ELECTRIC CONNECTOR

(71) Applicant: ACES ELECTRONICS CO., LTD., Zhongli, Taoyuan County (TW)

(72) Inventors: Nobukazu Kato, Tokyo (JP); Yohei Zama, Tokyo (JP)

(73) Assignee: ACES ELECTRONICS CO., LTD., Zhongli, Taoyuan County (TW)

( * ) Notice: Subject to any disclaimer, the term of this patent is extended or adjusted under 35 U.S.C. 154(b) by 0 days.

(21) Appl. No.: 14/302,053

(22) Filed: Jun. 11, 2014

(65) Prior Publication Data

US 2014/0370726 A1 Dec. 18, 2014

(30) Foreign Application Priority Data

Jun. 14, 2013 (JP) ..... 2013-125554

(51) Int. Cl.
*H01R 12/73* (2011.01)
*H01R 12/71* (2011.01)
*H01R 13/627* (2006.01)

(52) U.S. Cl.
CPC ..... *H01R 12/716* (2013.01); *H01R 12/73* (2013.01); *H01R 13/6275* (2013.01)

(58) Field of Classification Search
CPC ..... H01R 12/716; H01R 12/73; H01R 13/20; H01R 13/6275; H01R 13/631
(Continued)

(56) References Cited

U.S. PATENT DOCUMENTS 7,901,218 B2 * 3/2011 Sato et al. ..... 439/74
8,408,931 B2 * 4/2013 Sato et al. ..... 439/357
(Continued)

FOREIGN PATENT DOCUMENTS

JP 2008300371 A 12/2008

*Primary Examiner* — Amy Cohen Johnson
*Assistant Examiner* — Matthew T Dzierzynski
(74) *Attorney, Agent, or Firm* — Chiesa Shahinian & Giantomasi PC

(57) ABSTRACT

Provided is an electric connector mounted on a circuit board, including: a housing including a fitting portion fitted to a mating connector; a plurality of terminals disposed on the fitting portion; and lock metal fittings including an elastic portion and preventing separation of the mating connector, wherein the housing includes accommodating portions at both ends of the housing in the arrangement direction of the terminals to accommodate the lock metal fittings in the accommodating portions, and each of the lock metal fittings includes a fixed portion formed at one end of the lock metal fitting and fixed to the circuit board, a preventing surface formed at the other end of the lock metal fitting and preventing separation of the mating connector, a first folded portion extended from the preventing surface and folded in a substantially U shape, a second folded portion extended in the separation direction of the mating connector from the fixed portion, folded in a substantially U shape, and coming into contact with the first folded portion in the process of fitting of the mating connector, and a pair of projecting portions provided at the distal end of the first folded portion or in the vicinity of the distal end of the first folded portion, projecting in a direction crossing the arrangement direction of the terminals, and coming into contact with contact surfaces formed on the accommodating portion of the housing on the side in the separation direction of the mating connector.

2 Claims, 5 Drawing Sheets

(58) Field of Classification Search
USPC ..... 439/345, 357, 870
See application file for complete search history.

(56) References Cited

U.S. PATENT DOCUMENTS

| | | | | |
|---|---|---|---|---|
| 8,840,407 | B2 * | 9/2014 | Nose et al. | 439/74 |
| 8,845,339 | B2 * | 9/2014 | Ono | 439/74 |
| 8,992,234 | B2 * | 3/2015 | Yoshioka et al. | 439/74 |
| 2014/0227899 | A1 * | 8/2014 | Tanaka et al. | 439/357 |
| 2014/0227910 | A1 * | 8/2014 | Tanaka et al. | 439/626 |
| 2014/0256195 | A1 * | 9/2014 | Obikane et al. | 439/700 |
| 2014/0273587 | A1 * | 9/2014 | Takenaga et al. | 439/345 |
| 2014/0287610 | A1 * | 9/2014 | Komoto et al. | 439/350 |

* cited by examiner

ELECTRIC CONNECTOR

CROSS-REFERENCE TO RELATED APPLICATIONS

This application claims priority to Japanese Patent Application No. 2013-125554, filed on Jun. 14, 2013, which is incorporated herein by reference in its entirety.

BACKGROUND OF THE INVENTION

The present invention relates to an electric connector mounted on a circuit board and connected with a mating connector. There is a type of electric connector mounted on a circuit board and provided with a locking function for preventing unintended separation of a mating connector. For example, a male connector and a female connector may be connectable in the fitting direction crossing the circuit board at right angles. According to the technology, the male connector has a male reinforcing metal fitting, while the female connector has a female reinforcing metal fitting. The male reinforcing metal fitting and the female reinforcing metal fitting catch each other in the fitting direction to prevent unintended separation of the connectors.

According to this type of electric connector, however, the fit between the connectors may be separated when shock or the like is applied thereto at the time of drop. This separation of the fit may cause unintended separation of the connectors.

SUMMARY OF THE INVENTION

It is an object of the invention to provide an electric connector capable of preventing unintended separation of a mating connector.

An electric connector of the invention is an electric connector mounted on a circuit board, including: a housing including a fitting portion fitted to a mating connector; a plurality of terminals disposed on the fitting portion; and lock metal fittings including an elastic portion and preventing separation of the mating connector, wherein the housing includes accommodating portions at both ends of the housing in the arrangement direction of the terminals to accommodate the lock metal fittings in the accommodating portions, and each of the lock metal fittings includes a fixed portion formed at one end of the lock metal fitting and fixed to the circuit board, a preventing surface formed at the other end of the lock metal fitting and preventing separation of the mating connector, a first folded portion extended from the preventing surface and folded in a substantially U shape, a second folded portion extended in the separation direction of the mating connector from the fixed portion, folded in a substantially U shape, and coming into contact with the first folded portion in the process of fitting of the mating connector, and a pair of projecting portions provided at the distal end of the first folded portion or in the vicinity of the distal end of the first folded portion, projecting in a direction crossing the arrangement direction of the terminals, and coming into contact with contact surfaces formed on the accommodating portion of the housing on the side in the separation direction of the mating connector.

Further, in the electric connector of the invention, each of the lock metal fittings includes a perpendicular surface formed as a part of a connecting portion between the first folded portion and the fixed portion and extending perpendicularly to the separation direction of the mating connector, and includes a bended portion formed at one end of the perpendicular surface and projecting in the separation direction of the mating connector.

According to the invention, unintended separation of a mating connector is prevented.

DETAILED DESCRIPTION

Figure 1:
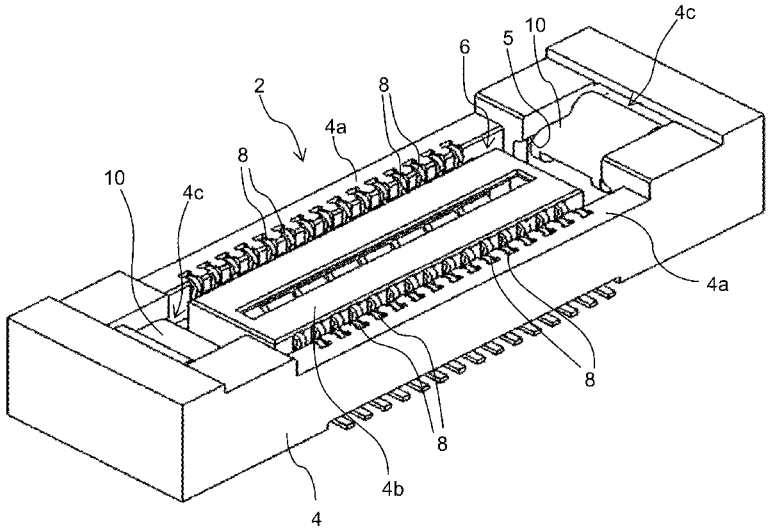
FIG. 1 is a perspective view illustrating the external appearance of a receptacle connector according to an embodiment.

An electric connector according to an embodiment of the invention is hereinafter described with reference to the drawings. FIG. 1 is a perspective view illustrating the external appearance of a receptacle connector (electric connector) according to this embodiment. As illustrated in FIG. 1, a receptacle connector 2 includes a housing 4 having a rectangular shape in the plan view. The housing 4 is placed on a not-shown circuit board. The housing 4 has a fitting portion 6 between two side walls 4*a* of the housing 4. The fitting portion 6 is an area to which a plug connector 20 (mating connector) (see FIG. 4) is fitted. A plurality of terminals 8 provided on the fitting portion 6 are arranged at equal intervals on the respective inner wall surfaces of the two side walls 4*a*.

A central convex portion 4*b* is provided within the fitting portion 6 of the housing 4. The central convex portion 4*b* extends in the arrangement direction of the terminals 8. Accommodating portions 4*c* are formed at both ends of the housing 4 in the arrangement direction of the terminals 8. The accommodating portions 4*c* accommodate lock metal fittings 10. The lock metal fittings 10 are made of elastic material, and configured to prevent unintended separation of the plug connector 20.

Figure 2:
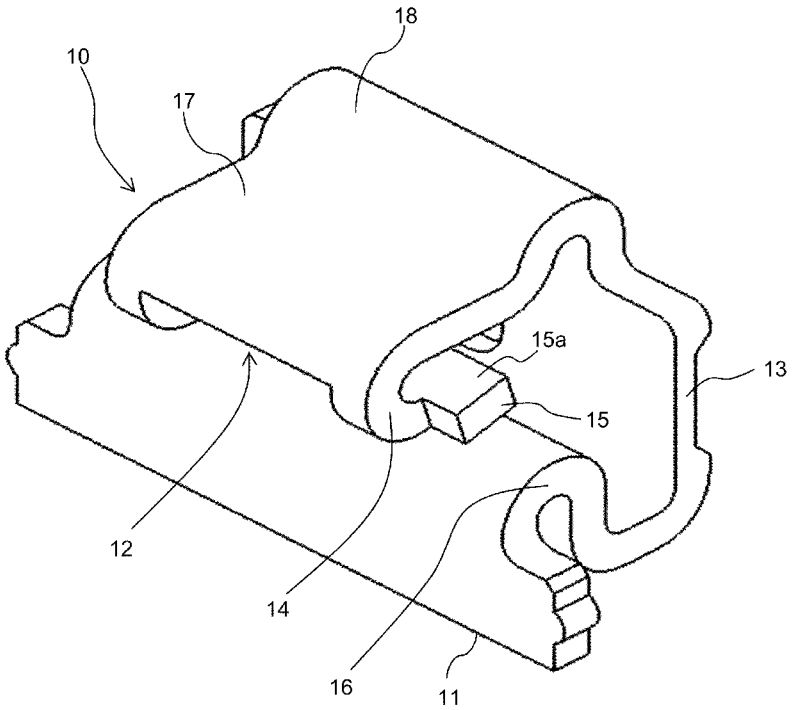
FIG. 2 is a perspective view of a lock metal fitting according to the embodiment.
Figure 3:
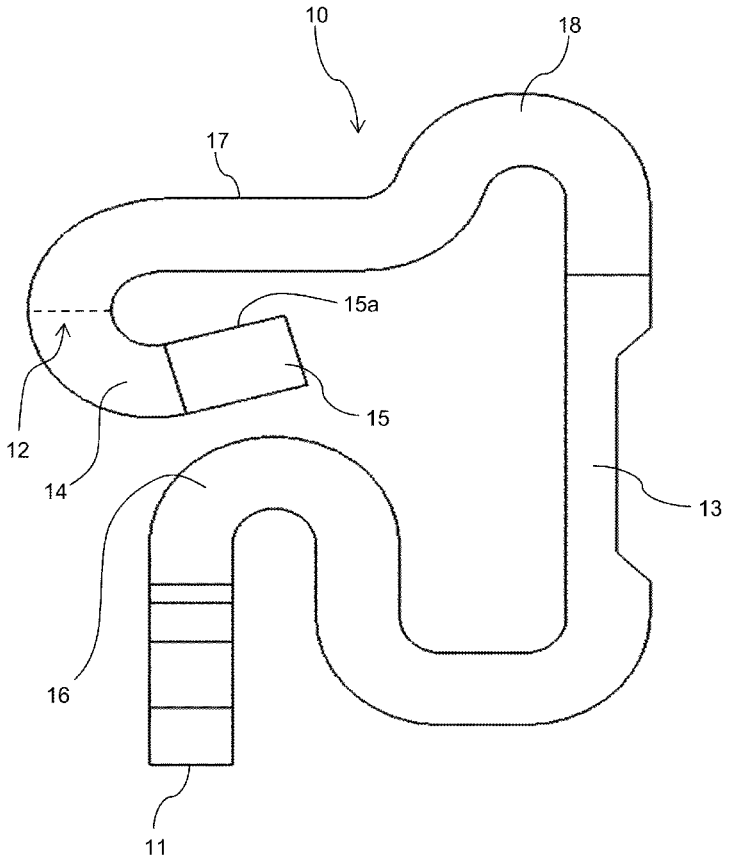
FIG. 3 is a side view of the lock metal fitting according to the embodiment.

As illustrated in a perspective view and a side view of FIGS. 2 and 3, a fixed portion 11 is formed at one end of the lock metal fitting 10. The fixed portion 11 is a portion fixed to the circuit board. A preventing surface 12 is formed at the other end of the lock metal fitting 10. The preventing surface 12 is a surface preventing separation of the plug connector 20. The fixed portion 11 and the preventing surface 12 are connected via a connecting portion 13. The lock metal fitting 10 has a first folded portion 14 extended from the preventing surface 12 and folded in a substantially U shape. A pair of projecting portions 15 having a rectangular column are provided at the distal end of the first folded portion 14. The projecting portions 15 project toward the side walls 4*a* of the housing 4 in the direction crossing the arrangement direction of the terminals 8 at right angles. Upper surfaces 15*a* of the respective projecting portions 15 are configured to come into contact with contact surfaces 5 formed on the inner wall surface side of the side walls 4*a* of the housing 4 and constituting the accommodating portion 4*c*.

The connecting portion 13 of the lock metal fitting 10 has a second folded portion 16. The second folded portion 16 is folded in a substantially U shape, and configured to come into contact with the first folded portion 14 in the fitting process of the plug connector 20. The second folded portion 16 is a portion extended in the separation direction of the plug connector 20 from the fixed portion 11.

The lock metal fitting 10 includes a perpendicular surface 17 in the connecting portion 13 connecting to the first folded portion 14. The perpendicular surface 17 extends perpendicularly to the separation direction of the plug connector 20. The lock metal fitting 10 further includes a bended portion 18 positioned at the one end of the perpendicular surface 17 and projecting in the separation direction of the plug connector 20.

Figure 4:
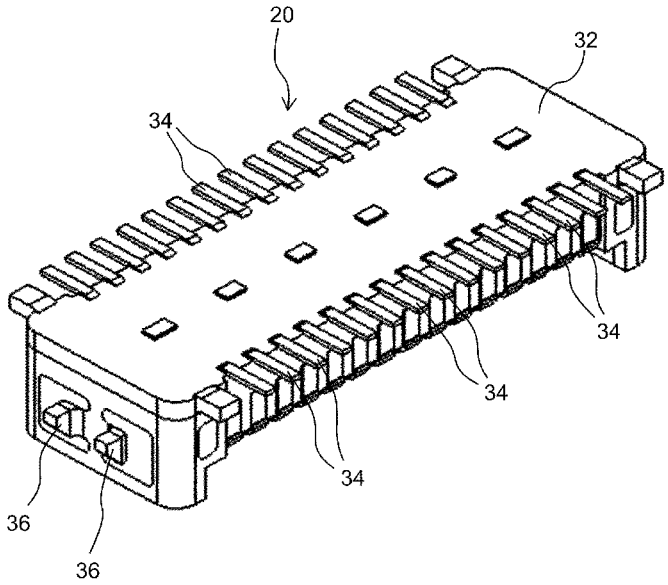
FIG. 4 is a perspective view illustrating the external appearance of a plug connector according to the embodiment.

FIG. 4 is a perspective view illustrating the external appearance of the plug connector 20 according to this embodiment. As can be seen from FIG. 4, the plug connector 20 has a housing 32 having a rectangular shape in the plan view. A plurality of plug terminals 34 are provided on both sides of surfaces of the housing 32. Two lock claws 36 are formed on both end surfaces of the housing 32 in the arrangement direction of the plug terminals 34. Each of the lock claws 36 has an upper surface functioning as a catching surface, and an inclined surface inclined toward the end surface of the housing 32 from the tip of the catching surface.

Figure 5:
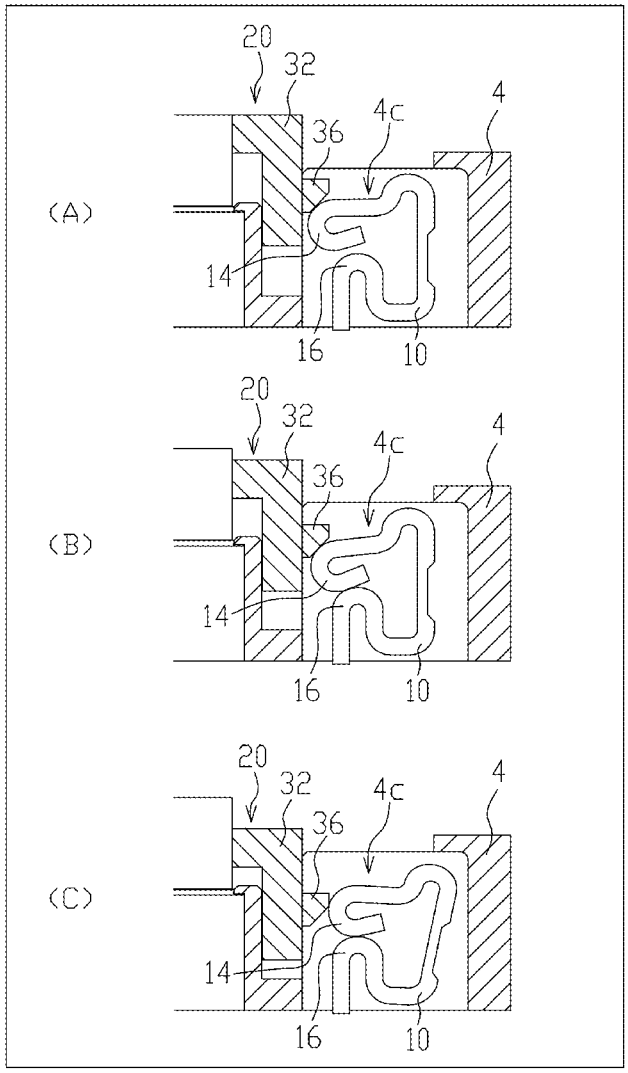
FIGS. 5A through 5C illustrate respective conditions of the lock metal fitting in fitting the plug connector to the receptacle connector according to the embodiment.

In fitting the plug connector 20 to the receptacle connector 2 according to this embodiment, the plug connector 20 is positioned above the fitting portion 6 of the receptacle connector 2, in which condition the plug connector 20 is pressed downward. As a consequence, the inclined surfaces of the lock claws 36 come into contact with the upper region of the U-shaped portion constituting the first folded portion 14 of the lock metal fitting 10 as illustrated in FIG. 5A. When the plug connector 20 is further pressed downward in this condition, the lock claws 36 press the U-shaped portion constituting the first folded portion 14 downward as illustrated in FIG. 5B. As a consequence, the lower region of the U-shaped portion comes into contact with the upper part of the U-shaped portion constituting the second folded portion 16 of the lock metal fitting 10. When the plug connector 20 is further pressed downward in this condition, the lock metal fitting 10 opens toward the end of the housing 4 as illustrated in FIG. 5C, whereby the lock claws 36 shift to a position lower than the tip of the U-shaped portion constituting the first folded portion 14. As a consequence, the catching surfaces of the lock claws 36 are caught by the preventing surface 12, whereby the plug connector 20 is fitted to the receptacle connector 2.

According to the receptacle connector 2 in this embodiment, upper surfaces 15*a* of a pair of the projecting portions 15 having a rectangular column formed at the distal end of the first folded portion 14 come into contact with the contact surfaces 5 formed on the inner wall side of the side walls 4*a* constituting the accommodating portion 4*c* of the housing 4 when it is attempted to separate the plug connector 20 from the receptacle connector 2. This contact between the upper surfaces 15*a* and the contact surfaces 5 prevents separation of the lock metal fitting 10 from the receptacle connector 2. Accordingly, prevention of unintended separation of the plug connector 20 is achievable.

When separation of the plug connector 20 from the receptacle connector 2 of this embodiment is desired, the bended portion 18 of the lock metal fitting 10 is pressed toward the end of the housing 4 using a suitable jig or the like. This action separates the catching surfaces of the lock claws 36 from the preventing surface 12, and thereby separating the plug connector 20 from the receptacle connector 2 is easily achieved.

While the projecting portions 15 are provided at the distal end of the first folded portion 14 according to this embodiment, the projecting portions 15 may be disposed in the vicinity of the distal end of the first folded portion 14.

The embodiment described herein has been presented for the purpose of easy understanding of the invention only, and is not intended to limit the scope of the invention. It should therefore be appreciated that the respective elements disclosed in this embodiment include all changes in design and equivalents without departing from the technical scope of the invention.

The invention claimed is:

1. An electric connector mounted on a circuit board, comprising:

an approximately rectangular housing in plan view;

a plurality of terminals; and two lock metal fittings formed by one flat plate, wherein:

the housing includes:

two accommodating portions at both ends of a longitudinal direction of the housing to accommodate the lock metal fittings, a fitting portion formed between the two accommodating portions, arranging the plurality of terminals in the longitudinal direction of the housing, and fitted to a mating connector, and contact surfaces formed at the accommodating portion, and faced to a surface of the circuit board when the housing mounts on the circuit board;

each of the lock metal fittings includes:

a single first folded portion folded to have a substantially U shape opened on an end side of the longitudinal direction of the housing, a fixed portion fixed to the circuit board, a moving portion formed between the first folded portion and the fixed portion, and displacing the first folded portion when the mating connector is fitted to the fitting portion;

a single preventing surface formed at the first folded portion, faced to the surface of the circuit board when the fixed portion is fixed to the circuit board, and preventing separation of the mating connector, a pair of projecting portions formed at the first folded portion, arranged on both sides of the preventing surface, and contacting with the contact surfaces at least when a force acts on the mating connector in the direction in which the mating connector is separated from the fitting portion, and a single second folded portion formed between the moving portion and the fixed portion, formed near the fixed portion, and folded to have a substantially U shape opened on a side of the fixed portion;

when the mating connector is fitted to the fitting portion:

first, the first folded portion is pressed in a side of the circuit board in an inserting direction of the mating connector by a lock claw formed at the mating connector, second, the first folded portion contacts with the second folded portion, third, the first folded portion moves to an end side of the longitudinal direction of the housing, finally, the first folded portion returns to a center side of the longitudinal direction of the housing, and the preventing surface locks the lock claw when the first folded portion returns to the center side of the longitudinal direction of the housing.

2. The electric connector of claim 1, wherein each of the lock metal fittings includes a perpendicular surface formed in a part of a connecting portion between the first folded portion and the fixed portion and extending perpendicularly to the separation direction of the mating connector, and includes a bent portion formed at one end of the perpendicular surface and projecting in the separation direction of the mating connector.

* * * * *